US010504388B2

(12) United States Patent
Garfinkle

(10) Patent No.: US 10,504,388 B2
(45) Date of Patent: Dec. 10, 2019

(54) MERCHANDISE PRICING AND DISPLAY TAG

(71) Applicant: Clamp Swing Pricing Company, Oakland, CA (US)

(72) Inventor: Benjamin Garfinkle, Piedmont, CA (US)

(73) Assignee: Clamp Swing Pricing Company, Oakland, CA (US)

( * ) Notice: Subject to any disclaimer, the term of this patent is extended or adjusted under 35 U.S.C. 154(b) by 24 days.

(21) Appl. No.: 14/636,769

(22) Filed: Mar. 3, 2015

(65) Prior Publication Data

US 2016/0260361 A1 Sep. 8, 2016

(51) Int. Cl.
*G09F 3/20* (2006.01)

(52) U.S. Cl.
CPC ..... *G09F 3/20* (2013.01)

(58) Field of Classification Search
USPC ..... 40/654.01, 778, 5, 668, 611.09, 618, 40/607.15, 649, 653
See application file for complete search history.

(56) References Cited

U.S. PATENT DOCUMENTS

| | | | | | |
|---|---|---|---|---|---|
| 1,335,434 | A | * | 3/1920 | Garred | 40/778 |
| 1,588,864 | A | * | 6/1926 | Weiss | 40/5 |
| 1,933,013 | A | * | 10/1933 | Hamilton | 40/5 |
| 2,592,386 | A | * | 4/1952 | Breakey | 40/658 |
| 4,507,886 | A | * | 4/1985 | Streeter | G09F 9/37 40/446 |
| 4,682,430 | A | * | 7/1987 | Ramsay | G09F 7/02 40/490 |

* cited by examiner

*Primary Examiner* — Joanne Silbermann
(74) *Attorney, Agent, or Firm* — Bay Area Technology Law Group PC

(57) ABSTRACT

A merchandise display tag for use in providing information about merchandise associated therewith. The display tag is provided with tabs having slots for receiving a primary pricing information insert within a primary field. The merchandise display tag can also include a secondary pricing information insert to reduce the total price library needed to cover anticipated signage needs. The merchandise display tag can also include means for receiving a bullet providing additional information about the goods being sold.

5 Claims, 2 Drawing Sheets

MERCHANDISE PRICING AND DISPLAY TAG

TECHNICAL FIELD

The present invention deals with a merchandise display tag which includes a sign body having a planar face with pockets having slots for receiving pricing information and a pocket for the receipt of a bullet displaying additional information related to merchandise associated with the display tag. The invention also teaches a unique way to change the pricing information displayed on the tag in order to minimize errors while allowing clerks to employ the present tag more efficiently than those merchandise display tags which are currently available.

BACKGROUND OF THE INVENTION

Retailers such as food markets vend upwards of thousands of items which are displayed on shelves and arranged in aisles. Such products, generally sold at small margin, must be displayed and be associated with signage intended to attract a customer and to differentiate similar products of differing brands or manufacturer from one another. Modern signage must not only passively inform consumers of the pricing, and other identification associated with a particular food product, but also have the ability to highlight those differentiating characteristics, such as ingredients, of two seemingly similar products, and do so in a way that captures a customer's attention.

In addition to signage being attractive, informative and stimulating, most food markets tend to purchase signage systems whose individual parts can be mixed and matched to minimize the need to maintain bloated signage inventories. In addition, if a retailer wishes to highlight the fact that a certain product was "organic" or "locally grown" or has some other attribute or characteristic which would encourage or stimulate purchase, supplemental tags, referred to here as "bullets," are often employed to catch the eye of the consumer as he or she surveys the myriad of products on display. Also, product pricing is often times changed without modifying other informational features of the sign. A product, for example, can first be offered at $2.99 per unit and, to stimulate consumer interest, the price changed to $2.49 per unit. Making this change quickly and accurately with a small price library remains a challenge.

It is thus an object of the present invention to provide a merchandise display tag which overcomes the limitations of similar tags currently employed in the field.

It is a further object of the present invention to provide a merchandise display tag which can readily accept and releasably secure supplemental product information in the form of a bullet thereto in a manner superior to similar signage of the prior art.

It is still a further object of the present invention to provide a merchandise display tag in which a portion of the primary pricing information can be changed readily while minimizing pricing errors and minimizing the size of the required pricing library characteristic of currently available signage.

These and further objects will be readily apparent when considering the following disclosure and appended claims.

SUMMARY OF THE INVENTION

A merchandise display tag for use in providing information about merchandise associated therewith, said merchandise display tag comprising a first substantially planar face whose perimeter is defined by a top, a bottom, a first side and a second side, said tag having pockets with slots for receiving a primary pricing information insert within a primary field, an indented pocket having a dimple protruding from said pocket, said dimple as a preferred embodiment having a ramped profile rising as said dimple is distanced from a first side of said tag, a bullet comprised of a second substantially planar face providing information about said merchandise, said bullet further comprising a region sized to extend within and be received by said pocket, said region having an opening for receiving said dimple when said bullet is introduced at said first side of said perimeter.

A merchandise display tag for use in providing information about merchandise associated therewith, said merchandise display tag comprising a first substantially planar face whose perimeter is defined by a top, a bottom, a first side and a second side, said tag having pockets with slots for receiving a primary pricing information insert removably secured to said planar face by said slots, said primary pricing information insert having fields for dollars, a decimal point and cents. The merchandise display tag also includes a secondary pricing information insert which modifies the information displayed by the primary insert. For example, secondary pricing insert can have a field for only cents, or a decimal point with cents, alone, or with other information such as "lb" or "ea", etc. Importantly, the secondary pricing insert is devoid of a field for dollars and when inserted and made part of said merchandise display tag does not reside over the dollars field of the primary pricing information insert. The secondary pricing insert can be releasably secured to said planar face positionable over said primary pricing information insert to reside only over selected fields thereof.

DETAILED DESCRIPTION OF THE INVENTION

Figure 1:
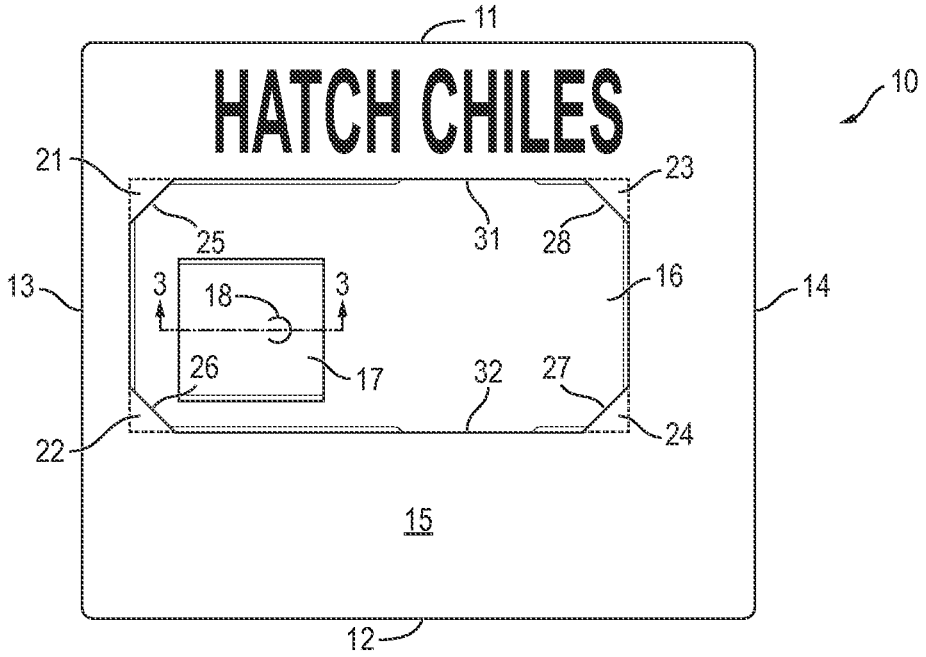
FIG. 1 is a front plan view of the merchandise display tag of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined important features of the invention in the summary above in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, merchandise display tag 10 is depicted. With some tags of this kind, product information is preprinted on its front face 15, in this case, the merchandise display tags are intended to be used in the sale of Hatch Chiles.

Planar face 15 of merchandise display tag 10 is bound by top 11, bottom 12, first side 13 and second side 14 noting that it is common that such signage is either square or rectangular such that first side 13 and second side 14 are orthogonal to the top 11 and bottom 12.

Figure 3:
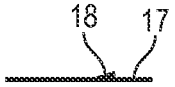
FIG. 3 is a cross-sectional view taken along line 3-3 on of FIG. 1.
Figure 4:
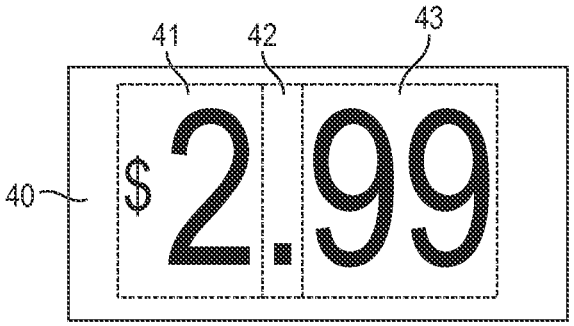
FIG. 4 is a front plan view of a primary pricing information insert in the form of a price tag for application to the merchandise display tag of FIG. 1.
Figure 5:
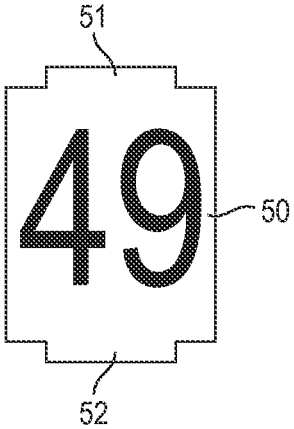
FIG. 5 is a front plan view of signage creating secondary pricing information when applied to the merchandise display tag of FIG. 4.

Merchandise display tag 10 is further characterized as having pockets 21, 22, 23 and 24 with slots 25, 26, 27 and 28 defining primary field 16 for receipt of pricing information inserts such as those depicted in FIG. 4 and slots 31 and 32 for receipt of secondary pricing inserts depicted in FIG. 5. The tag also possesses indented pocket 17 that includes dimple 18 protruding therefrom. As best visualized in reference to FIG. 3, dimple 18 is characterized as having a ramped profile rising as dimple 18 is distanced from first side 13 of tag 10.

Figure 2:
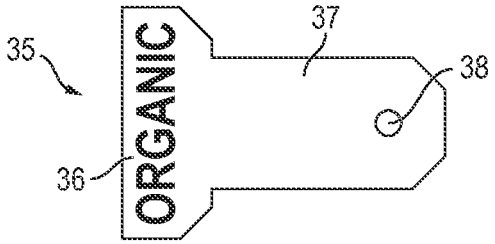
FIG. 2 is a front plan view of a bullet providing supplemental product information when used with the merchandise display tag on of FIG. 1.

As noted previously, there is oftentimes the need to apply supplemental signage to merchandise display tag 10. This supplemental signage 35, commonly referred to as a "bullet" is shown in FIG. 2, in this instance, messaging to the consumer that the product being sold is "organic." Bullet 35, as noted, is provided with a planar face providing information about the merchandise and further comprising region 37 sized to extend within and be received by pocket 17. Region 37 is characterized as having an opening 38 such that when bullet 35 is inserted at first side 13 of tag 10, opening 38 aligns with dimple 18, the combination being best visualized in reference to FIG. 7. As further noted in reference to FIG. 3, as a preferred embodiment, dimple 18 is characterized as having a ramped profile rising from first side 13 such that as region 37 passes under first side 13, region 37 flexes until opening 38 fully captures dimple 18. This facilitates joinder of bullet 35 with merchandise display tag 10 and further acts to resist removal of bullet 35 from its FIG. 7 joined position thus reducing the possibility of inadvertent removal of the bullet. However, removal resistance is not so great as to interfere with the duties of a store clerk but nevertheless, as noted, reduces the possibility of bullet 35 unintentionally being dislodged and separated from merchandise display tag 10.

Figure 7:
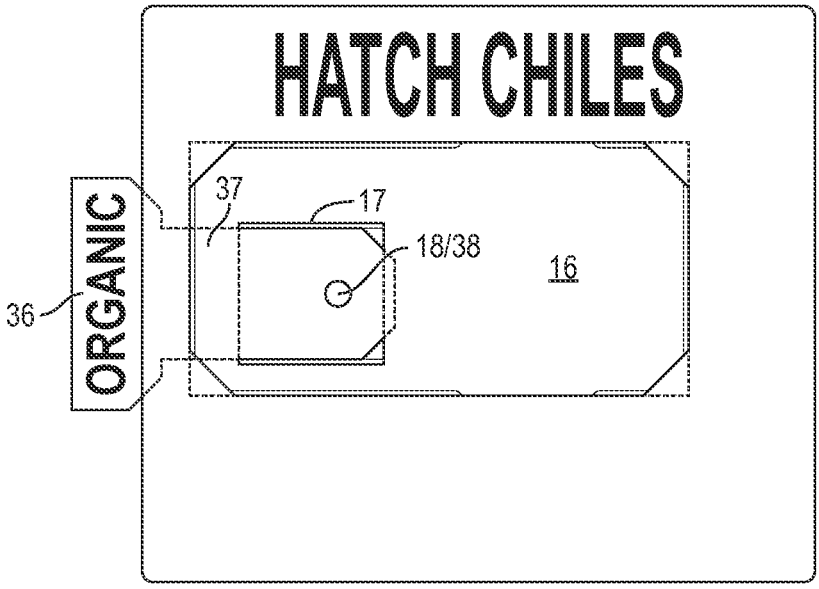
FIG. 7 is a front plan view of the signage of FIG. 1 with the bullet of FIG. 2 applied thereto.

It should further be appreciated that as pocket 17 resides within primary field 16 but indented from it, once primary pricing informational inserts have been inserted within primary field 16 and held in position by pockets 21, 22, 23 and 24, these inserts act to create a top boundary surface of the pocket further securing bullet 35 in place and further resisting the inadvertent dislodging of bullet 35 from its joined position and shown in FIG. 7.

Figure 6:
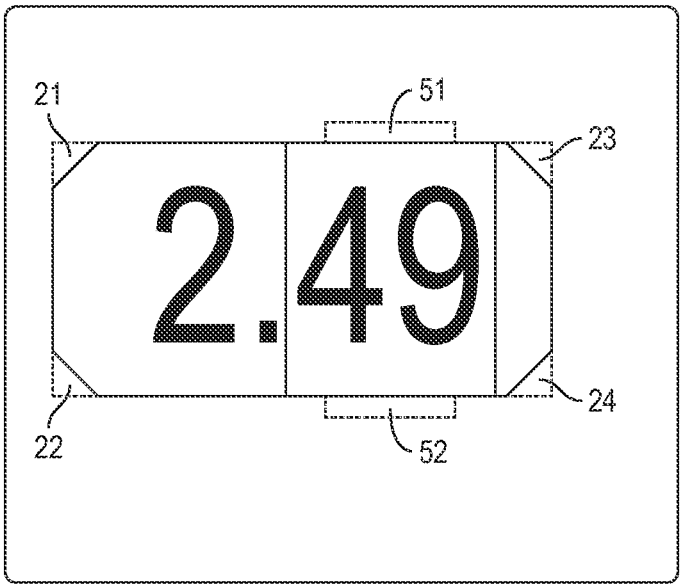
FIG. 6 is a front plan view of the signage of FIG. 4 with the secondary pricing information of FIG. 5 applied thereto.

A second feature of the present invention can be more readily appreciated in reference to FIGS. 4 through 6. Primary pricing information insert 40 is applied to merchandise display tag 10 by inserting its corners within pockets 21, 22, 23 and 24 through slots 25, 26, 27 and 28. By way of illustration, primary pricing information insert 40 indicates that merchandise is being sold for $2.99, the dollar portion of the price is situated with field 41, the decimal point separating dollars and cents is located within field 42 while the cents portion is located within field 43. Ordinarily, if there was a price adjustment so that the goods were being sold for $2.49, a clerk would remove primary pricing information insert 40 by prying the price tag out of all four corners and replacing it with a new insert. However the invention calls for only replacing 0.99 with 0.49. Merchants benefit as the invention minimizes the size of its total price library, making it easier to organize, thereby making it faster for clerks to locate the item they want. If prices ending in "0.99" represents 90% of a store's needs, then their library can have all complete prices ending in 0.99 from 0.99 up to say $9.99 covered with 5 unique price points, if they are printed on two sides so 1.99 is backed up with 2.99, etc. If the rest of the merchant's prices end in "9" like 2.49, then by printing the secondary price points showing only the cents ending in 9, the result is five unique secondary signs if printed on two sides. Thus, merchants are not required to stock 2.29, 2.39, 3.29, 3.39, 4.29, 4.39, etc. It also costs less to produce as more of a few items than fewer of many items.

The present invention deals with these issues by providing secondary pricing information insert 50 which is releasably secured to planar face 10 by passing extensions 51 and 52 into slots 31 and 32, respectively. Thus, when a clerk is told that the merchandise is to be reduced in price from $2.99 to $2.49, the store clerk need not concern himself with replacement of primary pricing information insert 40 but need only apply secondary pricing information insert 50 over primary pricing information insert 40 to reside only over the cents field 43 to the right of the decimal point. Thus, only field 43 would be covered. As such, there could be no errors introduced into this process as to the dollar portion all of the merchandise pricing. Further, applying secondary pricing information insert 50 simply within field 43 is a relatively simple process and removing it by simply disengaging extensions 51 and 52 from slots 31 and 32 is, again, a relatively simple process. As slots 31 and 32 are different than pockets 21, 22, 23 and 24, extensions 51 and 52 do not interfere with the integrity of the attachment of primary pricing information insert 40, again, making the price adjustment relatively simple and user-friendly to the average clerk.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A merchandise display tag for use in providing information about merchandise associated therewith, said merchandise display tag comprising a first substantially planar face and a perimeter, the tag having pockets with slots for receiving a primary pricing information insert within a primary field, a pocket indented from said primary field and having a dimple protruding therefrom, a bullet comprised of a second substantially planar face providing information about said merchandise, said bullet further comprising a region, a portion of which is sized to extend within and be received by said pocket indented from said primary field, said region having means for receiving said dimple when said bullet is introduced at said perimeter.

2. The merchandise display tag of claim 1 wherein said pocket indented from said primary field is located within said primary field.

3. The merchandise display tag of claim 2 wherein said region of said bullet sized to extend within and be received by said pocket indented from said primary field is secured thereto.

4. The merchandise display tag of claim 1 wherein said dimple is characterized as having a ramped profile rising as said dimple is distanced from said perimeter.

5. The merchandise display tag of claim 4 whereby said bullet is easier to insert within said pocket indented from said primary field than to remove therefrom.

* * * * *